US008921815B2

(12) United States Patent
Umeda et al.

(10) Patent No.: US 8,921,815 B2
(45) Date of Patent: Dec. 30, 2014

(54) TARGET SUPPLY DEVICE

(71) Applicant: Gigaphoton Inc., Oyama-shi, Tochigi (JP)

(72) Inventors: Hiroshi Umeda, Oyama (JP); Osamu Wakabayashi, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 14/083,020

(22) Filed: Nov. 18, 2013

(65) Prior Publication Data

US 2014/0138560 A1 May 22, 2014

(30) Foreign Application Priority Data

Nov. 20, 2012 (JP) ..... 2012-254187

(51) Int. Cl.
*H05G 2/00* (2006.01)

(52) U.S. Cl.
CPC ..... *H05G 2/006* (2013.01)
USPC ..... 250/504 R; 250/493.1

(58) Field of Classification Search
CPC ..... H05G 2/001; H05G 2/003; H05G 2/005; H05G 2/006; H05G 2/008; G03F 7/70008; G03F 7/70016; G03F 7/70025; G03F 7/70033
USPC ..... 250/493.1, 503.1, 504 R; 355/30
See application file for complete search history.

(56) References Cited

U.S. PATENT DOCUMENTS

| | | | | |
|---|---|---|---|---|
| 6,507,641 | B1 * | 1/2003 | Kondo et al. | 378/119 |
| 7,405,416 | B2 * | 7/2008 | Algots et al. | 250/493.1 |
| 7,405,461 | B2 * | 7/2008 | Yoneda | 257/510 |
| 2003/0223546 | A1 * | 12/2003 | McGregor et al. | 378/143 |
| 2010/0019173 | A1 * | 1/2010 | Someya et al. | 250/496.1 |
| 2011/0284774 | A1 * | 11/2011 | Ishihara et al. | 250/504 R |
| 2011/0310365 | A1 * | 12/2011 | Yabu et al. | 355/30 |
| 2012/0217422 | A1 * | 8/2012 | Yabu et al. | 250/504 R |
| 2012/0236273 | A1 * | 9/2012 | Kameda et al. | 355/30 |

* cited by examiner

*Primary Examiner* — Jack Berman
*Assistant Examiner* — David E Smith
(74) *Attorney, Agent, or Firm* — McDermott Will & Emery LLP

(57) ABSTRACT

A target supply device may include a tank including a nozzle, a first electrode provided with a first through-hole and disposed so that a center axis of the nozzle is positioned within the first through-hole, a second electrode that includes a main body portion provided with a second through-hole and a collection portion formed in a cylindrical shape extending in a direction from a circumferential edge of the second through-hole toward the nozzle and that is disposed so that the center axis of the nozzle is positioned within the second through-hole, a third electrode disposed within the tank, and a heating unit configured to heat the second electrode.

1 Claim, 7 Drawing Sheets

TARGET SUPPLY DEVICE

CROSS-REFERENCE TO RELATED APPLICATION

The present application claims priority from Japanese Patent Application No. 2012-254187 filed Nov. 20, 2012.

BACKGROUND

1. Technical Field

The present disclosure relates to target supply devices.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 60 nm to 45 nm, and further, microfabrication with feature sizes of 32 nm or less will be required. In order to meet the demand for microfabrication with feature sizes of 32 nm or less, for example, an exposure apparatus is needed in which a system for generating EUV light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

SUMMARY

A target supply device according to an aspect of the present disclosure may include a tank, a first electrode, a second electrode, a third electrode, and a heating unit. The tank may include a nozzle. The first electrode may be provided with a first through-hole and may be disposed so that a center axis of the nozzle is positioned within the first through-hole. The second electrode may include a main body portion provided with a second through-hole and a collection portion formed in a cylindrical shape extending in a direction from a circumferential edge of the second through-hole toward the nozzle, and may be disposed so that the center axis of the nozzle is positioned within the second through-hole. The third electrode may be disposed within the tank. The heating unit may be configured to heat the second electrode.

BRIEF DESCRIPTION OF THE DRAWINGS

Hereinafter, selected embodiments of the present disclosure will be described with reference to the accompanying drawings.

DETAILED DESCRIPTION

Figure 1:
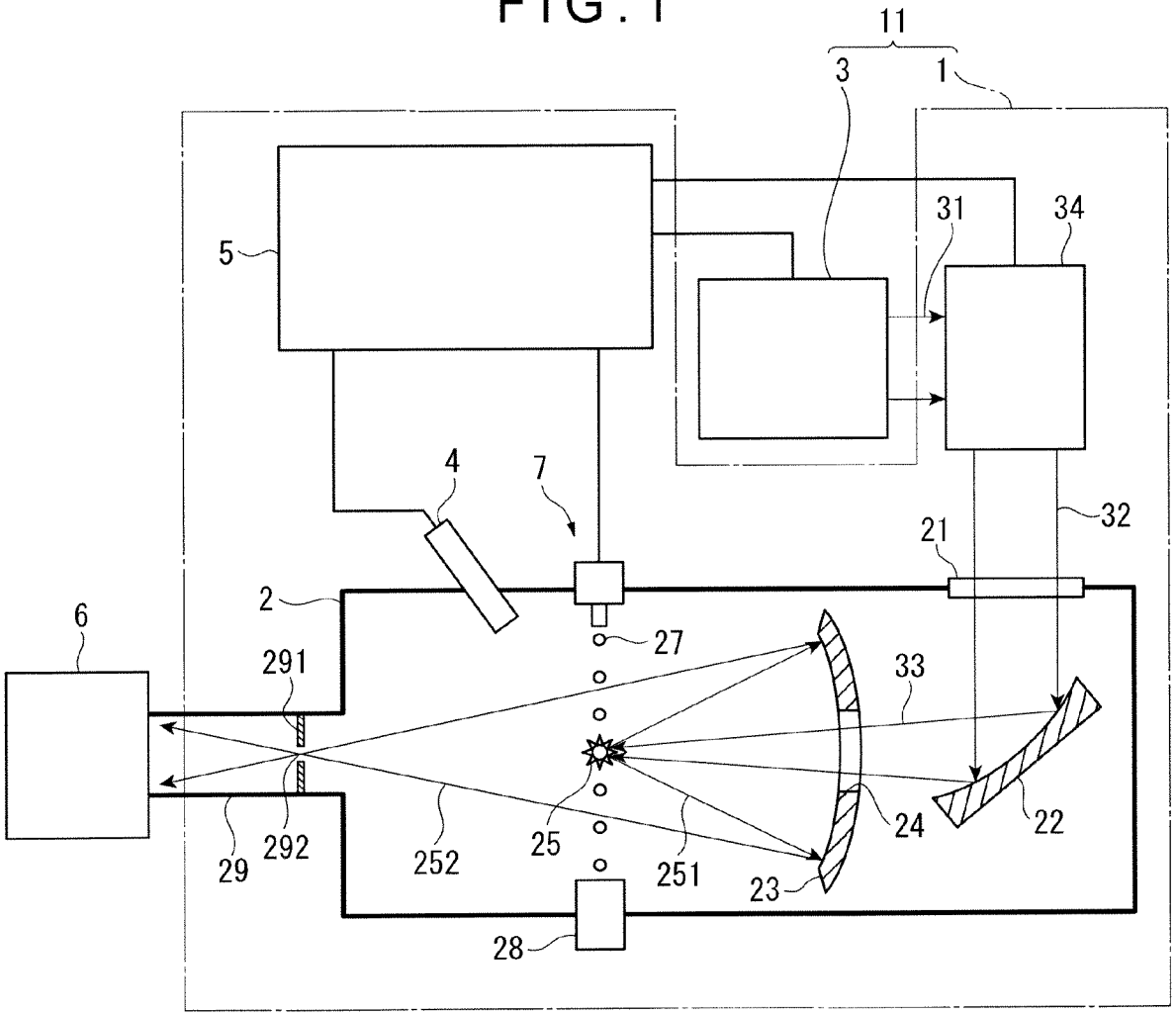
FIG. 1 schematically illustrates an exemplary configuration of an LPP type EUV light generation system.

Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Note that like elements are referenced by like reference numerals and characters, and duplicate descriptions thereof will be omitted herein.

CONTENTS

1. Overview
2. Overall Description of EUV Light Generation System
2.1 Configuration
2.2 Operation
3. EUV Light Generation System Including Target Supply Device
3.1 Terms
3.2 First Embodiment
3.2.1 Overview
3.2.2 Configuration
3.2.3 Operation
3.3 Second Embodiment
3.3.1 Overview
3.3.2 Configuration
3.3.3 Operation
3.4 Third Embodiment
3.4.1 Configuration
3.4.2 Operation
3.5 Variation

1. Overview

A target supply device according to an embodiment of the present disclosure may include a tank, a first electrode, a second electrode, a third electrode, and a heating unit. The tank may include a nozzle. The first electrode may be provided with a first through-hole and may be disposed so that a center axis of the nozzle is positioned within the first through-hole. The second electrode may include a main body portion provided with a second through-hole and a collection portion formed in a cylindrical shape extending in a direction from a circumferential edge of the second through-hole toward the nozzle, and may be disposed so that the center axis of the nozzle is positioned within the second through-hole. The third electrode may be disposed within the tank. The heating unit may be configured to heat the second electrode.

2. Overview of Euv Light Generation System

2.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As shown in FIG. 1 and described in detail below, the EUV light generation system 11 may include a chamber 2 and a target supply device 7. The chamber 2 may be sealed airtight. The target supply device 7 may be mounted onto the chamber 2, for example, to penetrate a wall of the chamber 2. A target material to be supplied by the target supply device 7 may include, but is not limited to, tin, terbium, gadolinium, lithium, xenon, or any combination thereof.

The chamber 2 may have at least one through-hole or opening formed in its wall, and a pulse laser beam 32 may travel through the through-hole/opening into the chamber 2. Alternatively, the chamber 2 may have a window 21, through which the pulse laser beam 32 may travel into the chamber 2. An EUV collector mirror 23 having a spheroidal surface may, for example, be provided in the chamber 2. The EUV collector mirror 23 may have a multi-layered reflective film formed on the spheroidal surface thereof. The reflective film may include a molybdenum layer and a silicon layer, which are alternately laminated. The EUV collector mirror 23 may have a first focus and a second focus, and may be positioned such that the first focus lies in a plasma generation region 25 and the second focus lies in an intermediate focus (IF) region 292 defined by the specifications of an external apparatus, such as an exposure apparatus 6. The EUV collector mirror 23 may have a through-hole 24 formed at the center thereof so that a pulse laser beam 33 may travel through the through-hole 24 toward the plasma generation region 25.

The EUV light generation system 11 may further include an EUV light generation controller 5 and a target sensor 4. The target sensor 4 may have an imaging function and detect at least one of the presence, trajectory, position, and speed of a target 27.

Further, the EUV light generation system 11 may include a connection part 29 for allowing the interior of the chamber 2 to be in communication with the interior of the exposure apparatus 6. A wall 291 having an aperture 293 may be provided in the connection part 29. The wall 291 may be positioned such that the second focus of the EUV collector mirror 23 lies in the aperture 293 formed in the wall 291.

The EUV light generation system 11 may also include a laser beam direction control unit 34, a laser beam focusing mirror 22, and a target collector 28 for collecting targets 27. The laser beam direction control unit 34 may include an optical element (not separately shown) for defining the direction into which the pulse laser beam 32 travels and an actuator (not separately shown) for adjusting the position and the orientation or posture of the optical element.

2.2 Operation

With continued reference to FIG. 1, a pulse laser beam 31 outputted from the laser apparatus 3 may pass through the laser beam direction control unit 34 and be outputted therefrom as the pulse laser beam 32 after having its direction optionally adjusted. The pulse laser beam 32 may travel through the window 21 and enter the chamber 2. The pulse laser beam 32 may travel inside the chamber 2 along at least one beam path from the laser apparatus 3, be reflected by the laser beam focusing mirror 22, and strike at least one target 27 as a pulse laser beam 33.

The target supply device 7 may be configured to output the target(s) 27 toward the plasma generation region 25 in the chamber 2. The target 27 may be irradiated with at least one pulse of the pulse laser beam 33. Upon being irradiated with the pulse laser beam 33, the target 27 may be turned into plasma, and rays of light 251 including EUV light may be emitted from the plasma. At least the EUV light included in the light 251 may be reflected selectively by the EUV collector mirror 23. EUV light 252, which is the light reflected by the EUV collector mirror 23, may travel through the intermediate focus region 292 and be outputted to the exposure apparatus 6. Here, the target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control at least one of: the timing when the target 27 is outputted and the direction into which the target 27 is outputted. Furthermore, the EUV light generation controller 5 may be configured to control at least one of: the timing when the laser apparatus 3 oscillates, the direction in which the pulse laser beam 33 travels, and the position at which the pulse laser beam 33 is focused. It will be appreciated that the various controls mentioned above are merely examples, and other controls may be added as necessary.

3. EUV Light Generation System Including Target Supply Device

3.1 Terms

Hereinafter, an upward direction in FIGS. 2, 3, 4, 5, and 6 will sometimes be referred to as a "+Z direction", a downward direction in the same drawings will sometimes be referred to as a "−Z direction", and the upward and downward directions will sometimes be collectively referred to as a "Z-axis direction". Likewise, a rightward direction in FIGS. 2, 3, 4, 5, and 6 will sometimes be referred to as a "+X direction", a leftward direction in the same drawings will sometimes be referred to as a "−X direction", and the rightward and leftward directions will sometimes be collectively referred to as an "X-axis direction". An upper-left diagonal direction in FIG. 7 will sometimes be referred to as the +Z direction, a lower-right diagonal direction in FIG. 7 will sometimes be referred to as the −Z direction, and the upper-left diagonal direction and the lower-right diagonal direction will sometimes be collectively referred to as the Z-axis direction. Likewise, an upper-right diagonal direction in FIG. 7 will sometimes be referred to as the +X direction, a lower-left diagonal direction in FIG. 7 will sometimes be referred to as the −X direction, and the upper-right diagonal direction and the lower-left diagonal direction will sometimes be collectively referred to as the X-axis direction. Furthermore, a forward direction in FIGS. 2, 3, 4, 5, 6, and 7 will sometimes be referred to as a "+Y direction", a rearward direction in the same drawings will sometimes be referred to as a "−Y direction", and the forward and rearward directions will sometimes be collectively referred to as a "Y-axis direction". Note that these expressions do not express relationships with a gravitational direction 10B.

3.2 First Embodiment

3.2.1 Overview

According to a first embodiment of the present disclosure, a target supply device may include a tank, a first electrode, a second electrode, a third electrode, and a heating unit. The tank may include a nozzle. The first electrode may be provided with a first through-hole and may be disposed so that a center axis of the nozzle is positioned within the first through-hole. The second electrode may include a main body portion provided with a second through-hole and a collection portion formed in a cylindrical shape extending in a direction toward the nozzle from a circumferential edge of the second through-hole, and may be positioned so that the center axis of the nozzle is positioned within the second through-hole. The third electrode may be disposed within the tank. The heating unit may heat the second electrode.

3.2.2 Configuration

Figure 2:
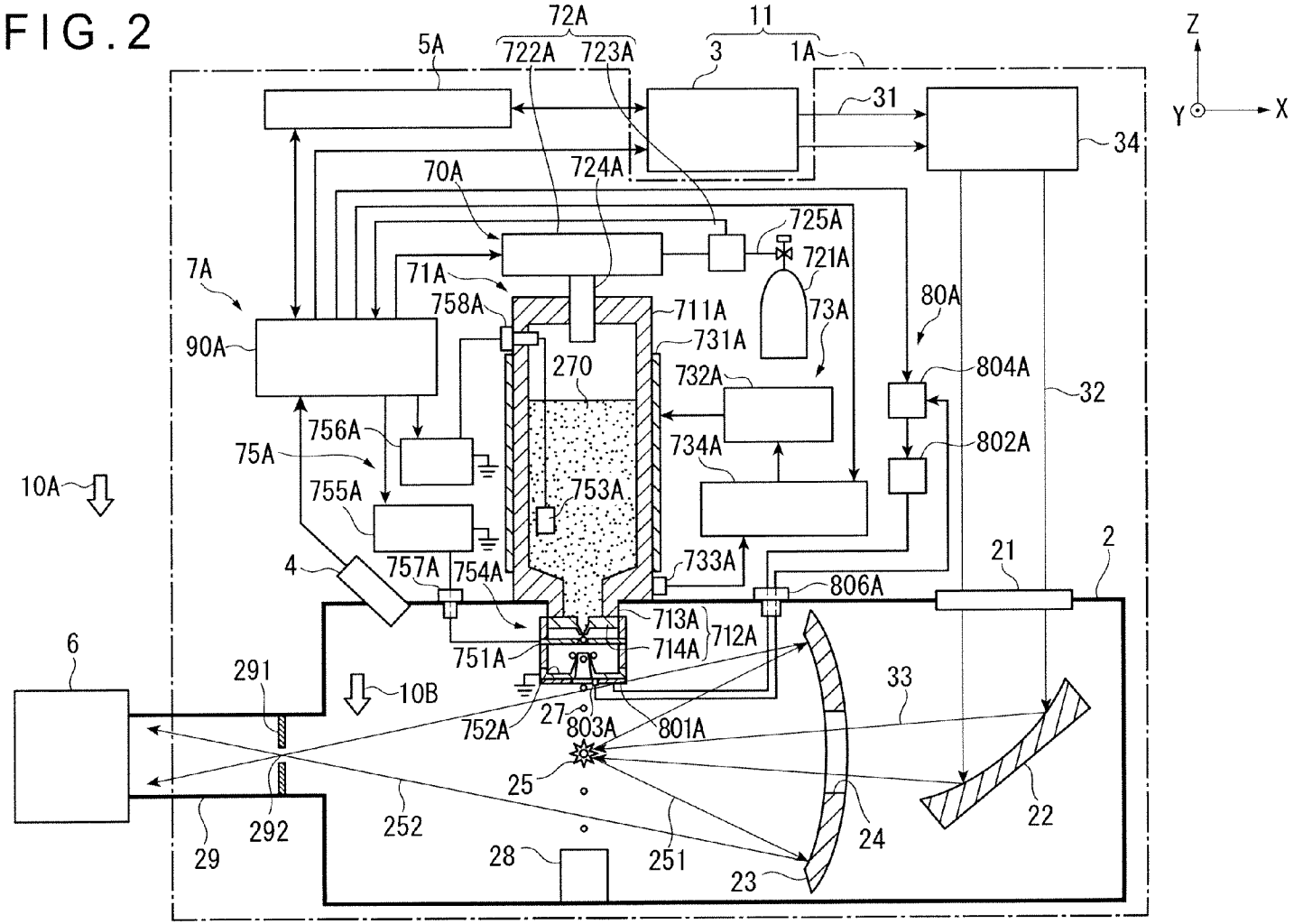
FIG. 2 illustrates the overall configuration of an EUV light generation system that includes a target supply device according to a first embodiment.
Figure 3:
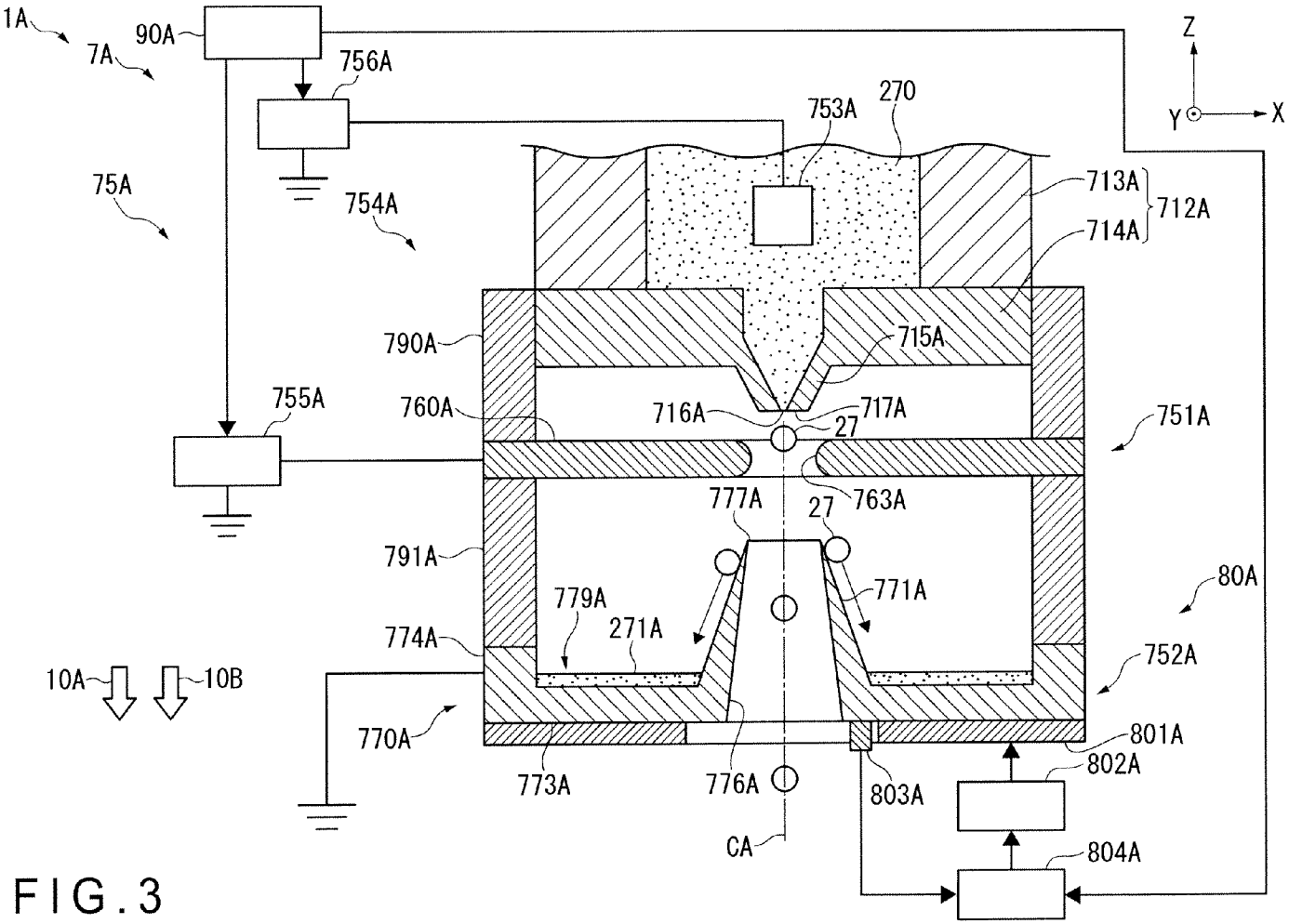
FIG. 3 schematically illustrates the configuration of a target supply device according to the first embodiment.

FIG. 2 illustrates the overall configuration of an EUV light generation system that includes the target supply device according to the first embodiment. FIG. 3 schematically illustrates the configuration of the target supply device according to the first embodiment.

An EUV light generation apparatus 1A may, as shown in FIG. 2, include the chamber 2 and a target supply device 7A. The target supply device 7A may include a target generation section 70A and a target control unit 90A. The laser apparatus 3 and an EUV light generation controller 5A may be electrically connected to the target control unit 90A.

The target generation section 70A may include a target generator 71A, a pressure control section 72A, a first temperature control section 73A, an electrostatic extraction section 75A, and a second temperature control section 80A.

The target generator 71A may, in its interior, include a tank 711A for holding a target material 270. The tank 711A may be cylindrical in shape. A nozzle 712A for outputting the target material 270 in the tank 711A to the chamber 2 as the targets 27 may be provided in the tank 711A. The target generator 71A may be provided so that the tank 711A is positioned outside the chamber 2 and the nozzle 712A is positioned inside the chamber 2. An axis of the nozzle 712A may, as shown in FIG. 3, match a set trajectory CA of the targets 27. The set trajectory CA may match the Z-axis direction.

As shown in FIGS. 2 and 3, the nozzle 712A may include a nozzle main body 713A and an output portion 714A.

The nozzle main body 713A may be formed in an approximately cylindrical shape. The nozzle main body 713A may be provided so as to protrude into the chamber 2 from a lower surface of the tank 711A.

The output portion 714A may be formed as an approximately circular plate. An outer diameter of the output portion 714A may be substantially the same as an outer diameter of the nozzle main body 713A. The output portion 714A may be provided so as to be flush against a leading end surface of the nozzle main body 713A. A circular truncated cone-shaped protruding portion 715A may be provided in a central area of the output portion 714A. The protruding portion 715A may be provided so as to make it easier for an electrical field to concentrate thereon. A nozzle hole 716A may be provided in the protruding portion 715A, in approximately the center of a leading end portion that configures an upper surface area of the circular truncated cone-shape of the protruding portion 715A. The diameter of the nozzle hole 716A may be 6 to 15 μm.

It is preferable for the output portion 714A to be configured of a material that achieves an angle of contact of greater than or equal to 90° between the output portion 714A and the target material 270. Alternatively, at least the surface of the output portion 714A may be coated with a material whose stated angle of contact is greater than or equal to 90°. The material having an angle of contact of greater than or equal to 90° may be one of SiC, $SiO_2$, $Al_2O_3$, molybdenum, and tungsten.

The tank 711A, the nozzle 712A, and the output portion 714A may be configured of electrically insulated materials. In the case where these elements are configured of materials that are not electrically insulated materials, for example, metal materials such as molybdenum, an electrically insulated material may be disposed between the chamber 2 and the target generator 71A, between the output portion 714A and a first electrode 751A and second electrode 752A (mentioned later), and so on. In this case, the tank 711A and a pulse voltage generator 755A, mentioned later, may be electrically connected.

Depending on how the chamber 2 is arranged, it is not necessarily the case that a pre-set output direction for the targets 27 (the axial direction of the nozzle 712A (called a "set output direction 10A" will match the gravitational direction 108. The configuration may be such that the targets 27 are outputted horizontally or at an angle relative to the gravitational direction 10B. Note that in the first embodiment, the chamber 2 may be arranged so that the set output direction 10A and the gravitational direction 10B match.

The pressure control section 72A may include an actuator 722A and a pressure sensor 723A. The actuator 722A may be linked to an upper end of the tank 711A via a pipe 724A. The actuator 722A may be connected to an inert gas bottle 721A via a pipe 725A. The actuator 722A may be electrically connected to the target control unit 90A. The actuator 722A may be configured to adjust a pressure within the tank 711A by controlling the pressure of an inert gas supplied from the inert gas bottle 721A based on a signal sent from the target control unit 90A.

The pressure sensor 723A may be provided in the pipe 725A. The pressure sensor 723A may be electrically connected to the target control unit 90A. The pressure sensor 723A may detect a pressure of the inert gas present in the pipe 725A and may send a signal corresponding to the detected pressure to the target control unit 90A.

The first temperature control section 73A may be configured to control a temperature of the target material 270 within the tank 711A. The first temperature control section 73A may include a first heater 731A, a first heater power source 732A, a first temperature sensor 733A, and a first temperature controller 734A.

The first heater 731A may be provided on an outer circumferential surface of the tank 711A.

The first heater power source 732A may cause the first heater 731A to emit heat by supplying power to the first heater 731A based on a signal from the first temperature controller 734A. As a result, the target material 270 within the tank 711A can be heated via the tank 711A.

The first temperature sensor 733A may be provided on the outer circumferential surface of the tank 711A, toward the location of the nozzle 712A, or may be provided within the tank 711A. The first temperature sensor 733A may detect a temperature primarily at a location where the first temperature sensor 733A is installed as well as the vicinity thereof in the tank 711A, and may send a signal corresponding to the detected temperature to the first temperature controller 734A. The temperature at the location where the first temperature sensor 733A is installed as well as the vicinity thereof can be substantially the same as the temperature of the target material 270 within the tank 711A.

The first temperature controller 734A may be configured to output, to the first heater power source 732A, a signal for controlling the temperature of the target material 270 to a predetermined temperature, based on a signal from the first temperature sensor 733A.

The electrostatic extraction section 75A may include the first electrode 751A, the second electrode 752A, a third electrode 753A, an anchoring portion 754A, the pulse voltage generator 755A, and a voltage source 756A. As will be described later, the electrostatic extraction section 75A may extract the targets 27 from the nozzle hole 716A of the output portion 714A using a difference between a potential of the first electrode 751A and a potential of the third electrode 753A. In addition, the electrostatic extraction section 75A may output the targets 27 extracted from the nozzle hole 716A into the chamber 2 while accelerating those targets 27 using a difference between a potential of the first electrode 751A and a potential of the second electrode 752A.

The first electrode 751A may be configured of a conductive material. The pulse voltage generator 755A may be electrically connected to the first electrode 751A via a feedthrough 757A. The first electrode 751A may include a first plate-shaped portion 760A.

The first plate-shaped portion 760A may be formed as an approximately circular plate. An outer diameter of the first plate-shaped portion 760A may be greater than the outer diameter of the output portion 714A. A circular first through-hole 763A may be formed in the center of the first plate-shaped portion 760A. An end area of the first plate-shaped portion 760A on the outer side in the planar direction thereof may be anchored to the anchoring portion 754A so that the first plate-shaped portion 760A opposes the nozzle 712A at a position in a predetermined distance apart from the nozzle 712A.

An edge of the first through-hole 763A may be formed having a smoothly-curved surface shape. Forming the edge of the first through-hole 763A having a curved surface shape in this manner makes it possible to suppress an electrical field from concentrating at that area.

The second electrode 752A may be configured of a conductive material. The second electrode 752A may be grounded. The second electrode 752A may include a main body portion 770A and a collection portion 771A.

The main body portion 770A may include a second plate-shaped portion 773A and a cylindrical portion 774A.

The second plate-shaped portion 773A may be formed as an approximately circular plate. An outer diameter of the second plate-shaped portion 773A may be substantially the same as the outer diameter of the first plate-shaped portion 760A of the first electrode 751A. A circular second through-hole 776A may be formed in the center of the second plate-shaped portion 773A. A diameter of the second through-hole 776A may be greater than the diameter of the first through-hole 763A of the first electrode 751A.

The cylindrical portion 774A may be formed in an approximately cylindrical shape extending from a top surface on an end on the outer side of the second plate-shaped portion 773A in the planar direction thereof, in a direction orthogonal to that planar direction (that is, in the +Z direction). The cylindrical portion 774A may be anchored to the anchoring portion 754A so that the main body portion 770A opposes the first plate-shaped portion 760A at a position in a predetermined distance apart from the first plate-shaped portion 760A.

The collection portion 771A may be formed as an approximately truncated cone-shaped cylinder extending from a circumferential edge of the second through-hole 776A in the second plate-shaped portion 773A, in the same direction as the cylindrical portion 774A (that is, in the +Z direction). A leading end area 777A of the collection portion 771A may be pointed. An outer circumferential surface of the collection portion 771A, an upper surface of the second plate-shaped portion 773A, and an inner circumferential surface of the cylindrical portion 774A can form a groove portion 779A.

Here, in the case where a tip of the leading end area 777A is formed having a flat surface rather than being pointed, targets 27 that deviate from the set trajectory CA and adhere to the leading end area 777A may remain on the leading end area 777A as-is. As opposed to this, in the case where the leading end area 777A is pointed, targets 27 that deviate from the set trajectory CA and adhere to the leading end area 777A can flow along the outer circumferential surface of the collection portion 771A and accumulate in the groove portion 779A.

The third electrode 753A may be disposed in the target material 270 within the tank 711A. The voltage source 756A may be electrically connected to the third electrode 753A via a feedthrough 758A.

The anchoring portion 754A may anchor the first electrode 751A and the second electrode 752A to the nozzle 712A. The anchoring portion 754A may include a first anchoring member 790A and a second anchoring member 791A.

The first anchoring member 790A and the second anchoring member 791A may be formed of an insulative material in an approximately cylindrical shape. An inner diameter of the first anchoring member 790A and an inner diameter of the second anchoring member 791A may be substantially the same as an outer diameter of the nozzle main body 713A and the outer diameter of the output portion 714A. An outer diameter of the first anchoring member 790A and an outer diameter of the second anchoring member 791A may be substantially the same as the outer diameter of the first plate-shaped portion 760A and the outer diameter of the second plate-shaped portion 773A. A dimension of the first anchoring member 790A in an axial direction thereof may be smaller than a dimension of the second anchoring member 791A in an axial direction thereof.

The first anchoring member 790A may be anchored to the nozzle 712A so that the nozzle 712A is fitted into the first anchoring member 790A. A lower end of the first anchoring member 790A may be positioned lower than a leading end of the protruding portion 715A. The first plate-shaped portion 760A of the first electrode 751A may be anchored to the lower end of the first anchoring member 790A.

By anchoring the elements in this manner, the axis of the first through-hole 763A can substantially match the axis of the nozzle 712A.

An upper end of the second anchoring member 791A may be anchored to a lower surface of the first plate-shaped portion 760A. The cylindrical portion 774A of the second electrode 752A may be anchored to a lower end of the second anchoring member 791A.

By anchoring the elements in this manner, an axis of the collection portion 771A and an axis of the second through-hole 776A can substantially match the axis of the nozzle 712A. A distance between the second plate-shaped portion 773A of the second electrode 752A and the first plate-shaped portion 760A of the first electrode 751A can be greater than a distance between the protruding portion 715A and the first plate-shaped portion 760A.

The pulse voltage generator 755A and the voltage source 756A may be grounded. The pulse voltage generator 755A and the voltage source 756A may be electrically connected to the target control unit 90A.

The second temperature control section 80A may serve as a heating unit according to the present disclosure. The second temperature control section 80A may be configured to control a temperature of the second electrode 752A. The second temperature control section 80A may include a second heater 801A, a second heater power source 802A, a second temperature sensor 803A, and a second temperature controller 804A.

The second heater 801A may be provided on a second surface of the second plate-shaped portion 773A that is on the side thereof that is further from the nozzle 712A (in the −Z direction). As shown in FIG. 2, the second heater power source 802A may be electrically connected to the second heater 801A via a feedthrough 806A.

The second heater power source 802A may cause the second heater 801A to emit heat based on a signal from the second temperature controller 804A. Accordingly, targets 27 that adhere to the leading end area 777A of the collection portion 771A, target material 271A that has accumulated in the groove portion 779A, and so on can be heated via the second electrode 752A.

The second temperature sensor 803A may be provided on an outer circumferential surface of the cylindrical portion 774A, or may be provided on an inner circumferential surface of the collection portion 771A, within the groove portion 779A, or the like. The second temperature controller 804A may be electrically connected to the second temperature sensor 803A via the feedthrough 806A. The second temperature sensor 803A may detect a temperature primarily at a location where the second temperature sensor 803A is installed as well as the vicinity thereof at the second electrode 752A, and may be configured to send a signal corresponding to the detected temperature to the second temperature controller 804A. The temperature at the location where the second temperature sensor 803A is installed as well as the vicinity thereof can be substantially the same as the temperature of the target material 271A within the groove portion 779A.

The second temperature controller 804A may be configured to output, to the second heater power source 802A, a signal for controlling the temperature of the targets 27 that adhere to the leading end area 777A, the target material 271A that has accumulated in the groove portion 779A, and so on to a predetermined temperature, based on a signal from the second temperature sensor 803A.

The target control unit 90A may control the temperature of the target material 270 in the target generator 71A by sending a signal to the first temperature controller 734A. The target control unit 90A may control a pressure in the target generator 71A by sending a signal to the actuator 722A of the pressure control section 72A. The target control unit 90A may control the temperature of the targets 27 that adhere to the leading end area 777A, the target material 271A that has accumulated in the groove portion 779A, and so on by sending a signal to the second temperature controller 804A.

3.2.3 Operation

Figure 4:
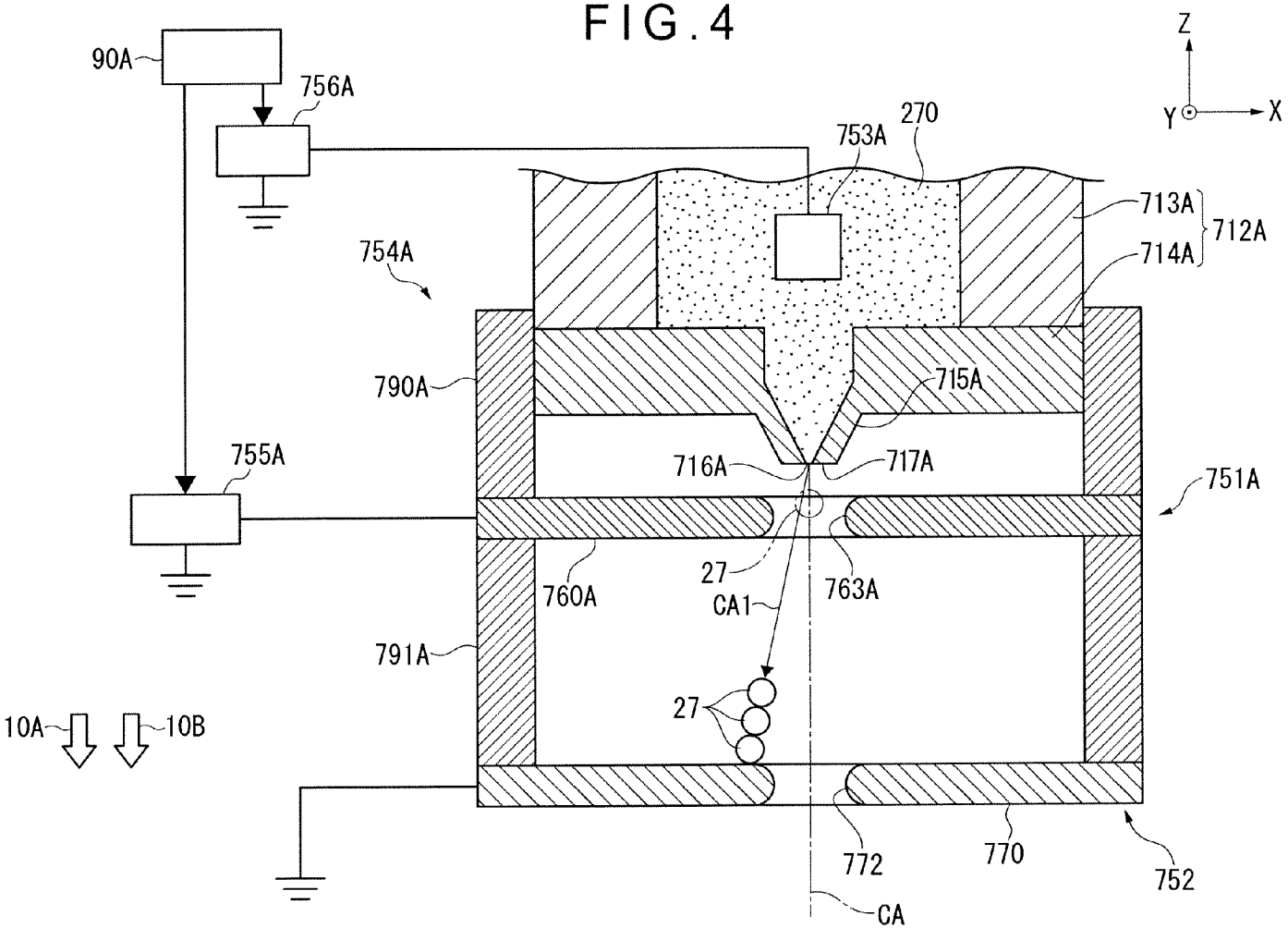
FIG. 4 is a diagram illustrating an issue in first to third embodiments, and illustrates a state in which a target supply device is outputting targets.

FIG. 4 is a diagram illustrating an issue in the first to third embodiments, and illustrates a state in which the target supply device is outputting targets.

Note that the following describes operations performed by the target supply device 7A using a case where the target material 270 is tin as an example.

First, an issue that the target supply devices according to the first through third embodiments solve will be described.

The configuration of the target supply device in the EUV light generation apparatus may, as shown in FIG. 4, be the same as that of the EUV light generation apparatus 1A according to the first embodiment, with the exception of a second electrode 752.

The second electrode 752 may be configured only of a second plate-shaped portion 770 that includes a second through-hole 772.

In this target supply device, a first temperature control section may heat the target material 270 within a target generator to a predetermined temperature greater than or equal to the melting point of the target material 270. The voltage source 756A may apply a positive high voltage (for example, 50 kV) to the target material 270 in the target generator.

Then, in a state in which the high voltage is applied to the target material 270, the pulse voltage generator 755A may reduce the voltage applied to the first electrode 751A from the high voltage to a low voltage (for example, 45 kV); the low voltage may be held for a predetermined amount of time and then returned to the high voltage once again. At this time, the target material 270 may be extracted in a shape of a droplet using electrostatic force in synchronization with the timing at which the voltage at the first electrode 751A drops. The target 27 can be given a positive charge. The target 27 can then be accelerated by the grounded (0 kV) second electrode 752 and can pass through the second through-hole 772 of the second electrode 752. The target 27 that has passed through the second through-hole 772 can be irradiated with a pulse laser beam upon reaching a plasma generation region.

Here, when the target material 270 in the target generator is extracted from the nozzle 712A in a shape of a droplet, the trajectory of the target 27 can shift from the set trajectory CA toward a direction approximately orthogonal to the set trajectory CA (that is, a direction approximately orthogonal to the Z-axis direction). A reason why the trajectory of the target 27 shifts from the set trajectory CA can be postulated as follows.

When the target 27 is generated, a region where the target 27 makes contact and a region where the target 27 does not make contact can be present in a ring-shaped region on an inner edge side of a leading end surface 717A of the protruding portion 715A. In this case, the region, of the ring-shaped region on the inner edge side of the leading end surface 717A, that has made contact with the target 27 can be more easily wetted by the target material 270. As a result, a center position of the target 27 can shift from the set trajectory CA to, for example, the left (the −X direction).

When the target 27 whose center position has shifted from the set trajectory CA in this manner is extracted by the first electrode 751A, a trajectory CA1 of the target 27 can be shifted further to the left than the set trajectory CA. When the trajectory CA1 shifts from the set trajectory CA, the target 27 can be pulled by electrostatic force toward an outer edge side of the second through-hole 772, and can then adhere to the second plate-shaped portion 770. The target material can harden once the target 27 adheres to the second plate-shaped portion 770. An electrical field can then concentrate at the hardened target material, and a force that pulls the next target 27 toward the hardened target material can arise. The targets 27 can build up in a branch shape manner due to this force, and the targets 27 can ultimately cease to pass through the second through-hole 772 and be outputted from the target supply device.

To solve the issue illustrated in FIG. 4, the collection portion 771A and the second temperature control section 80A may be provided in the target supply device 7A, as shown in FIG. 3.

In the target supply device 7A, the second temperature control section 80A may heat the second electrode 752A to a predetermined temperature greater than or equal to the melting point of the target material 270. The target supply device 7A may then extract the target material 270 in the target generator 71A in a shape of a droplet.

When the target 27 is extracted from the nozzle 712A, the trajectory of the target 27 can shift from the set trajectory CA toward a direction approximately orthogonal to the Z-axis direction. This target 27 can adhere to the outer circumferential surface of the collection portion 771A. Because the collection portion 771A is heated to the predetermined temperature greater than or equal to the melting point of the target material 270, upon adhering to the collection portion 771A, the target 27 can flow under the force of gravity without hardening. As a result, the target material 271A can accumulate in the groove portion 779A in liquid form. Accordingly, a force that pulls the next target 27 toward the collection portion 771A can be prevented from arising.

After this, when the targets 27 are extracted consecutively, the region, of the ring-shaped region on the inner edge side of the leading end surface 717A, that makes contact with the target 27 can gradually spread. When the targets 27 do not make contact with the entire ring-shaped region, the center position of the targets 27 shifts from the set trajectory CA toward a direction approximately orthogonal to the Z-axis direction, and thus the trajectory of the targets 27 extracted from the nozzle 712A can shift from the set trajectory CA and the targets 27 can then accumulate in the groove portion 779A. At this time, the target material 271A can accumulate in the groove portion 779A in liquid form, and thus the targets 27 can be prevented from building up in a branch shape manner on the second electrode 752A. As a result, a force that pulls the next target 27 toward the collection portion 771A can be prevented from arising.

Then, when the target 27 makes contact with the entire ring-shaped region on the inner edge of the leading end surface 717A, the center position of the target 27 can substantially match the set trajectory CA. As a result, the target 27 can pass through the second through-hole 776A and be outputted from the target supply device 7A without making contact with the collection portion 771A.

As described thus far, by using the collection portion 771A and the second temperature control section 80A, the target supply device 7A can prevent the solid target material from building up on the second electrode 752A in a branch shape manner. Accordingly, the target supply device 7A can output the targets 27 properly.

3.3 Second Embodiment

3.3.1 Overview

According to the target supply device according to the second embodiment of the present disclosure, the second electrode may include an electrical field moderating portion that is formed in a cylindrical shape extending in the same direction as the collection portion from an outer side of the collection portion of the main body portion and is provided so that a leading end of the electrical field moderating portion in the extending direction is positioned closer to the nozzle than a leading end of the collection portion in the extending direction.

3.3.2 Configuration

Figure 5:
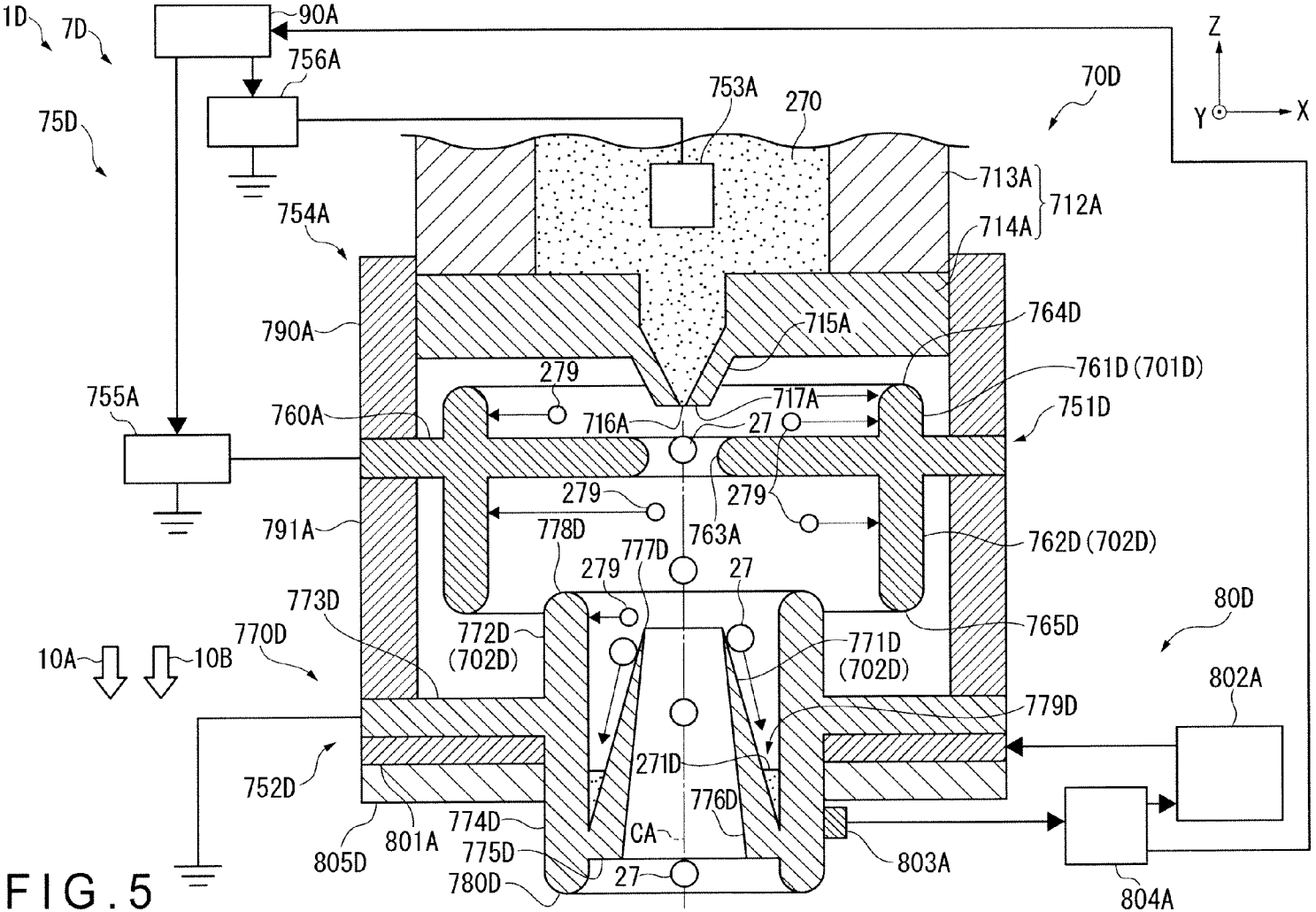
FIG. 5 schematically illustrates the configuration of a target supply device according to the second embodiment.

FIG. 5 schematically illustrates the configuration of a target supply device according to the second embodiment.

As shown in FIG. 5, an EUV light generation apparatus 1D according to the second embodiment may employ the same configuration as the EUV light generation apparatus 1A of the first embodiment, with the exception of a target generation section 70D of a target supply device 7D.

In the second embodiment, the chamber 2 may be arranged so that the set output direction 10A and the gravitational direction 10B match.

Aside from an electrostatic extraction section 75D and a second temperature control section 80D, the target generation section 70D may employ the same configuration as the target generation section 70A of the first embodiment.

Aside from a first electrode 751D and a second electrode 752D, the electrostatic extraction section 75D may employ the same configuration as the electrostatic extraction section 75A of the first embodiment.

The first electrode 751D may be configured of a conductive material. The first electrode 751D may include the first plate-shaped portion 760A, a first cylindrical portion 761D, and a second cylindrical portion 762D.

The first cylindrical portion 761D may be formed having an approximately cylindrical shape, extending from a first surface of the first plate-shaped portion 760A on the side closer to the nozzle 712A, toward the nozzle 712A.

The second cylindrical portion 762D may be formed having an approximately cylindrical shape extending from a second surface of the first plate-shaped portion 760A that is on the opposite side thereof to the first surface, in a direction moving away from the nozzle 712A. An axis of the second cylindrical portion 762D may substantially match an axis of the first cylindrical portion 761D. An inner diameter and an outer diameter of the second cylindrical portion 762D may be the same as an inner diameter and an outer diameter of the first cylindrical portion 761D. A dimension of the second cylindrical portion 762D in an axial direction thereof may be greater than a dimension of the first cylindrical portion 761D in an axial direction thereof.

A leading end area 764D of the first cylindrical portion 761D and a leading end area 765D of the second cylindrical portion 762D may each be formed having a smoothly-curved surface shape. Forming the leading end area 764D of the first cylindrical portion 761D and the leading end area 765D of the second cylindrical portion 762D having curved surface shapes makes it possible to suppress an electrical field from concentrating at those areas.

Note that at least one of the first cylindrical portion 761D and the second cylindrical portion 762D may be configured separate from the first plate-shaped portion 760A and may then be affixed to the first plate-shaped portion 760A through welding or the like.

The second electrode 752D may be configured of a conductive material. The second electrode 752D may be grounded. The second electrode 752D may include a main body portion 770D, a collection portion 771D, and a third cylindrical portion 772D.

The main body portion 770D may include a second plate-shaped portion 773D, a fourth cylindrical portion 774D, and a protruding portion 775D.

The second plate-shaped portion 773D may be formed as an approximately circular plate. An outer diameter of the second plate-shaped portion 773D may be substantially the same as the outer diameter of the first plate-shaped portion 760A of the first electrode 751D.

The fourth cylindrical portion 774D may be formed in an approximately cylindrical shape extending from an inner side of the second plate-shaped portion 773D in the planar direction thereof, in a direction orthogonal to that planar direction (downward, in FIG. 5).

The protruding portion 775D may be provided so as to protrude from an inner circumferential surface of the fourth cylindrical portion 774D. The protruding portion 775D may be formed in an approximately circular ring-shape. A space surrounded by the protruding portion 775D may configure a second through-hole 776D. A diameter of the second through-hole 776D may be greater than the diameter of the first through-hole 763A of the first electrode 751D.

The collection portion 771D may be formed as an approximately truncated cone-shaped cylinder extending from a first surface of the protruding portion 775D on the side thereof that is closer to the nozzle 712A (the +Z direction side), in a direction approximately orthogonal to that first surface (that is, in the +Z direction). A leading end area 777D of the collection portion 771D may be pointed. By forming the leading end area 777D to be pointed in this manner, the leading end area 777D can achieve the same effects as the leading end area 777A of the first embodiment.

The third cylindrical portion 772D may serve as an electrical field moderating portion according to the present disclosure. The third cylindrical portion 772D may be formed in an approximately cylindrical shape extending from an end on an inner side of the second plate-shaped portion 773D in the planar direction thereof, in the same direction as the collection portion 771D (the +Z direction). An inner diameter and an outer diameter of the third cylindrical portion 772D may be the same as an inner diameter and an outer diameter of the fourth cylindrical portion 7740. The third cylindrical portion 772D may be formed so that the leading end area 777D of the collection portion 771D does not protrude outward from a leading end area 778D of the third cylindrical portion 772D.

A groove portion 779D may be formed in an area between an inner circumferential surface of the third cylindrical portion 772D and the inner circumferential surface of the fourth cylindrical portion 774D, and the outer circumferential surface of the collection portion 771D. The targets 27 that have deviated from the set trajectory CA can accumulate in the groove portion 779D as a target material 271D.

The second plate-shaped portion 773D of the second electrode 752D may be anchored to the lower end of the second anchoring member 791A.

By anchoring the elements in this manner, the axis of the collection portion 771D and the axis of the second through-hole 776D can substantially match the axis of the nozzle 712A. The leading end area 765D of the second cylindrical portion 762D can be located at a position in a predetermined distance apart from the second plate-shaped portion 773D. The leading end area 765D of the second cylindrical portion 762D can be positioned further downward (in the −Z direction) than the leading end area 778D of the third cylindrical portion 772D. A distance between the second plate-shaped portion 773D of the second electrode 752D and the first plate-shaped portion 760A of the first electrode 751D can be greater than a distance between the protruding portion 715A and the first plate-shaped portion 760A.

The leading end area 778D of the third cylindrical portion 772D and a leading end area 780D of the fourth cylindrical portion 774D may be formed having a smoothly-curved surface shape. Forming the leading end area 778D and the leading end area 780D having a curved surface shape in this manner makes it possible to suppress an electrical field from concentrating at those areas.

Meanwhile, the leading end area 778D of the third cylindrical portion 772D can be positioned closer to the nozzle 712A than the leading end area 777D of the collection portion 771D. By positioning the leading end area 778D closer to the nozzle 712A than the leading end area 777D, an electrical field can be limited from concentrating at the leading end area 777D even in the case where the leading end area 777D is pointed in order to suppress the targets 27 from remaining on the leading end area 777D.

The first cylindrical portion 761D can surround the set trajectory CA of the targets 27 in an area between the tip of the nozzle 712A and the first electrode 751D. The first cylindrical portion 761D can configure a first surrounding portion 701D according to the present disclosure.

The second cylindrical portion 762D, the collection portion 771D, and the third cylindrical portion 772D can surround the set trajectory CA of the targets 27 in an area between the first electrode 751D and the second electrode 752D. The second cylindrical portion 762D, the collection portion 771D, and the third cylindrical portion 772D can collectively configure a second surrounding portion 702D according to the present disclosure.

Note that at least one of the collection portion 771D, the third cylindrical portion 772D, and the fourth cylindrical portion 774D may be configured separate from the second plate-shaped portion 773D and may then be affixed to the second plate-shaped portion 773D through welding or the like.

The second temperature control section 80D may serve as a heating unit according to the present disclosure. The second temperature control section 80D may be configured to control a temperature of the second electrode 752D. Aside from a ring member 805D, the second temperature control section 80D may employ the same configuration as the second temperature control section 80A according to the first embodiment.

The second heater 801A may be provided on a second surface of the second plate-shaped portion 773D that is on the side thereof that is further from the nozzle 712A (in the −Z direction).

The second temperature sensor 803A may be provided on an outer circumferential surface of the fourth cylindrical portion 774D, or may be provided on an inner circumferential surface of the collection portion 771D, within the groove portion 779D, or the like.

The ring member 805D may be formed in an approximately circular ring-shape that is substantially the same as that of the second plate-shaped portion 773D. The ring member 805D may be provided so that the second heater 801A is sandwiched between the ring member 805D and the second plate-shaped portion 773D.

3.3.3 Operation

Figure 6:
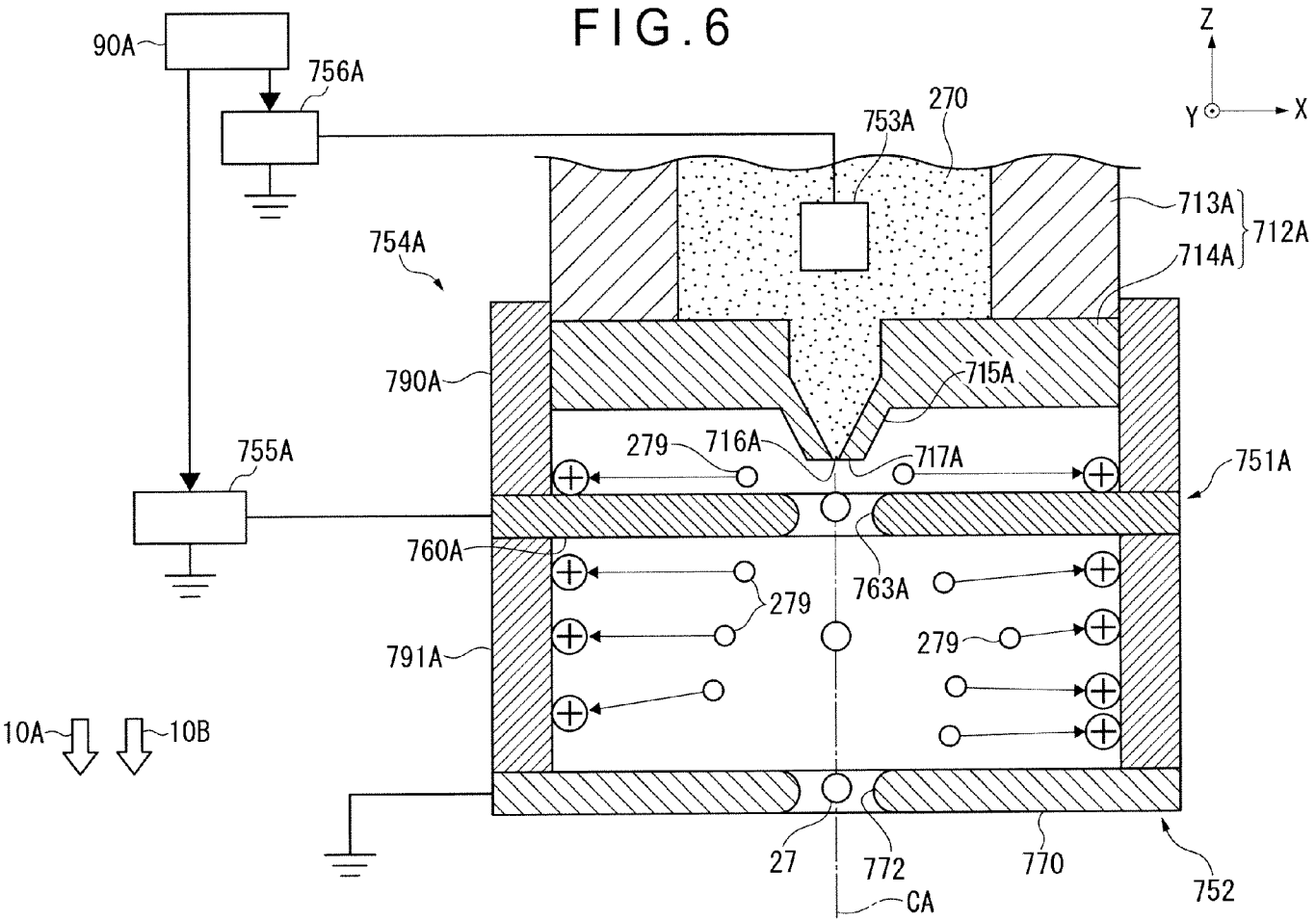
FIG. 6 is a diagram illustrating an issue in second and third embodiments, and illustrates a state in which a target supply device is outputting targets.

FIG. 6 is a diagram illustrating an issue in the second and third embodiments, and illustrates a state in which the target supply device is outputting targets.

In the following, descriptions of operations identical to those in the first embodiment will be omitted.

First, an issue that the target supply devices according to the second and third embodiments solve will be described.

The target supply device shown in FIG. 6 may have the same configuration as the target supply device shown in FIG. 4.

In this target supply device, when the target material 270 is extracted in a shape of a droplet from the nozzle 712A, positively-charged mist 279 may be produced from the target material. The size of the mist 279 particles may be smaller than the size of the target 27. The mist 279 may move in a direction approximately orthogonal to the Z-axis direction in the area between the nozzle 712A and the first electrode 751A, the area between the first electrode 751A and the second electrode 752, and so on. The mist 279 may adhere to an inner circumferential surface of the first anchoring member 790A, an inner circumferential surface of the second anchoring member 791A, and so on. When the mist 279 adheres to the inner circumferential surface of the first anchoring member 790A, the inner circumferential surface of the second anchoring member 791A, and so on, those inner circumferential surfaces may become positively charged.

As a result of this charge, at least one of an insulation withstand voltage between the nozzle 712A and the first electrode 751A and an insulation withstand voltage between the first electrode 751A and the second electrode 752 can drop, leading to an insulation breakdown. Furthermore, a potential distribution on the set trajectory CA of the targets 27 can change, and the direction in which the charged targets 27 are outputted can shift toward a direction approximately orthogonal to the Z-axis direction.

To solve this problem, the first surrounding portion 701D and the second surrounding portion 702D may be provided in the target supply device 7D, as shown in FIG. 5.

In the target supply device 7D, the second temperature control section 80D may heat the second electrode 752D to a predetermined temperature greater than or equal to the melting point of the target material 270. The target supply device 7D may then extract the target material 270 in the target generator 71A in a shape of a droplet.

In the case where the trajectory of the targets 27 has shifted from the set trajectory CA, the targets 27 can adhere to the outer circumferential surface of the collection portion 771D. Because the collection portion 771D is heated to the predetermined temperature greater than or equal to the melting point of the target material 270, upon adhering to the collection portion 771D, the target 27 can flow under the force of gravity without hardening. As a result, the target material 271D can accumulate in the groove portion 779D in liquid form. Accordingly, a force that pulls the next target 27 toward the collection portion 771D can be prevented from arising.

After this, when the targets 27 are extracted consecutively, the trajectory of the targets 27 can be shifted from the set trajectory CA until the targets 27 make contact with the entire region of the ring-shaped region on the inner edge side of the leading end surface 717A. However, the targets 27 that have shifted from the set trajectory CA can accumulate in the groove portion 779D in liquid form, and thus the targets 27 can be prevented from building up on the second electrode 752D in a branch shape manner. As a result, a force that pulls the next target 27 toward the collection portion 771D can be prevented from arising.

When the center position of the target 27 substantially matches the set trajectory CA, the target 27 can pass through the second through-hole 776D and be outputted from the target supply device 7D without making contact with the collection portion 771D.

In the target supply device 7D, the mist 279 can be produced when the target material 270 is extracted in a shape of a droplet. The mist 279 that moves in the direction approximately orthogonal to the set trajectory CA in the area between the nozzle 712A and the first electrode 751D can adhere to the first cylindrical portion 761D located between the set trajectory CA and the first anchoring member 790A. The mist 279 that moves in the direction approximately orthogonal to the set trajectory CA in the area between the first electrode 751D and the second electrode 752D can adhere to the second cylindrical portion 762D, the collection portion 771D, and the third cylindrical portion 772D located between the set trajectory CA and the second anchoring member 791A. As a result, the first surrounding portion 701D and the second surrounding portion 702D can prevent the mist 279 from adhering to the first anchoring member 790A and the second anchoring member 791A, and the inner circumferential surface of the first anchoring member 790A and the inner circumferential surface of the second anchoring member 791A can be prevented from being positively charged.

As described above, in the target supply device 7D, an electrical field can be limited from concentrating at the leading end area 777D even in the case where the leading end area 777D is pointed in order to suppress the targets 27 from remaining on the leading end area 777D.

Furthermore, the target supply device 7D can prevent the insulation withstand voltage between the nozzle 712A and the first electrode 751D and the insulation withstand voltage between the first electrode 751D and the second electrode 752D from dropping, and can thus prevent the occurrence of insulation breakdown. Furthermore, changes in the output direction of the charged targets 27 can be suppressed.

3.4 Third Embodiment

3.4.1 Configuration

Figure 7:
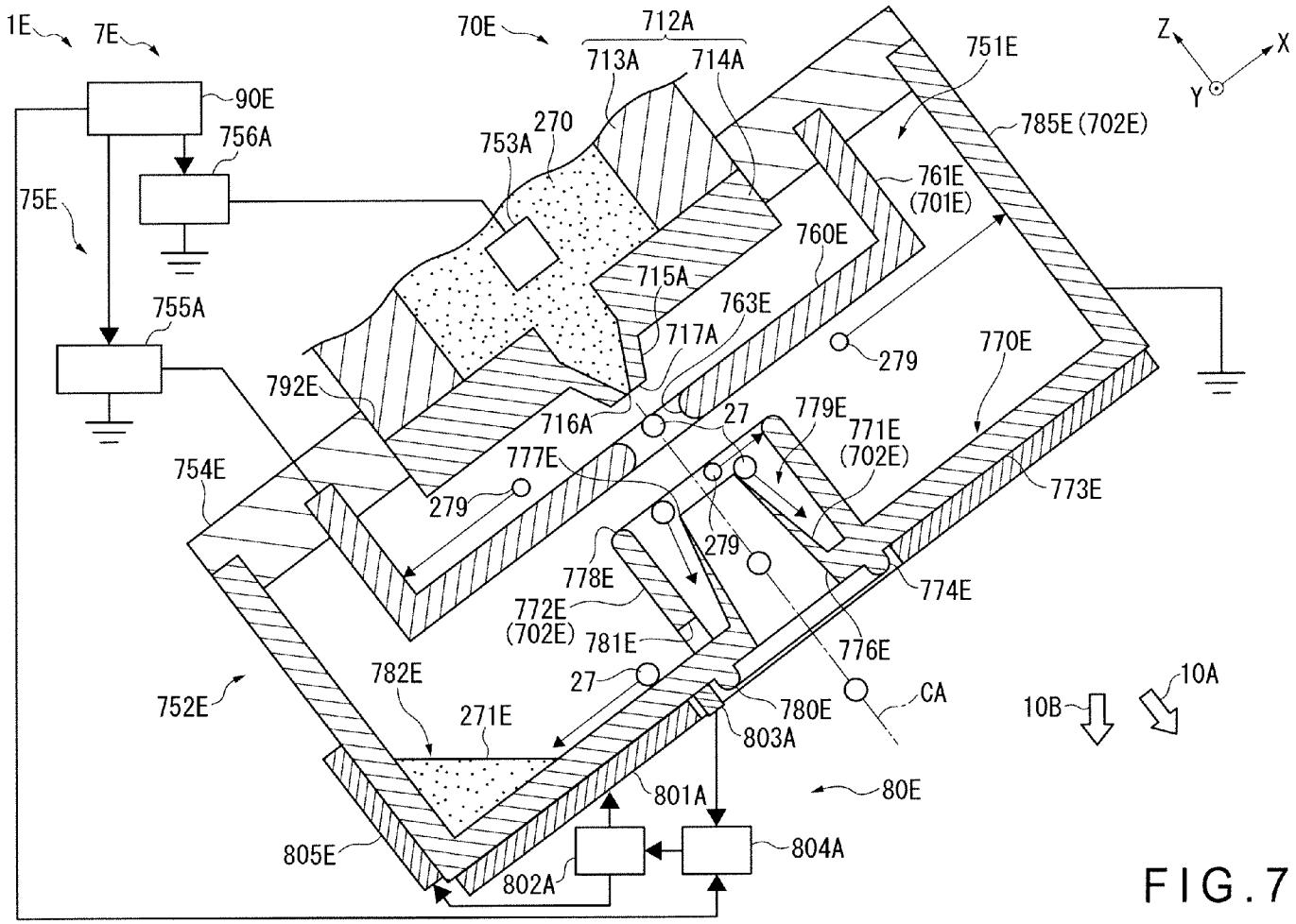
FIG. 7 schematically illustrates the configuration of a target supply device according to the third embodiment.

FIG. 7 schematically illustrates the configuration of a target supply device according to a third embodiment.

As shown in FIG. 7, an EUV light generation apparatus 1E according to the third embodiment may employ the same configuration as the EUV light generation apparatus 1A of the first embodiment, with the exception of a target generation section 70E of a target supply device 7E.

In the third embodiment, the chamber 2 may be arranged so that the set output direction 10A is slanted relative to the gravitational direction 10B.

Aside from an electrostatic extraction section 75E, a second temperature control section 80E, and a target control unit 90E, the target generation section 70E may employ the same configuration as the target generation section 70A of the first embodiment.

Aside from a first electrode 751E, a second electrode 752E, and an anchoring portion 754E, the electrostatic extraction section 75E may employ the same configuration as the electrostatic extraction section 75A of the first embodiment.

The first electrode 751E may be configured of a conductive material. The first electrode 751E may include a first plate-shaped portion 760E and a first cylindrical portion 761E.

The first plate-shaped portion 760E may be formed as an approximately circular plate. An outer diameter of the first plate-shaped portion 760E may be greater than the outer diameter of the output portion 714A. A circular first through-hole 763E may be formed in the center of the first plate-shaped portion 760E.

The first cylindrical portion 761E may be formed in an approximately cylindrical shape extending from an end area on the outer side of the first plate-shaped portion 760E in the planar direction thereof, in a direction orthogonal to that planar direction.

A leading end side of the first cylindrical portion 761E may be anchored in a groove of the anchoring portion 754E so that the first plate-shaped portion 760E opposes the nozzle 712A at a position in a predetermined distance apart from the nozzle 712A.

An edge of the first through-hole 763E may be formed having a smoothly-curved surface shape. Forming the edge of the first through-hole 763E having a curved surface shape in this manner makes it possible to suppress an electrical field from concentrating at that area.

The second electrode 752E may be configured of a conductive material. The second electrode 752E may be grounded. The second electrode 752E may include a main body portion 770E, a second cylindrical portion 785E, a collection portion 771E, and an electrical field moderating portion 772E.

The main body portion 770E may include a second plate-shaped portion 773E and a third cylindrical portion 774E.

The second plate-shaped portion 773E may be formed as an approximately circular plate. An outer diameter of the second plate-shaped portion 773E may be greater than the outer diameter of the first plate-shaped portion 760E. A circular second through-hole 776E may be formed in the center of the second plate-shaped portion 773E. An inner diameter of the second through-hole 776E may be greater than an inner diameter of the first through-hole 763E of the first electrode 751E.

The third cylindrical portion 774E may be formed in an approximately cylindrical shape extending from slightly further outside from an end on the inner side of the second plate-shaped portion 773E in the planar direction thereof, in a direction orthogonal to that planar direction (the lower-right diagonal direction, in FIG. 7).

The second cylindrical portion 785E may be provided on an end on the outer side of the second plate-shaped portion 773E in the planar direction thereof. An area where the second cylindrical portion 785E and the second plate-shaped portion 773E intersect may configure a receptacle area 782E.

The collection portion 771E may be formed as an approximately truncated cone-shaped cylinder extending from a circumferential edge of the second through-hole 776E in the second plate-shaped portion 773E, in the same direction as the second cylindrical portion 785E (that is, in the +Z direction). A leading end area 777E of the collection portion 771E may be pointed. By forming the leading end area 777E to be pointed in this manner, the leading end area 777E can achieve the same effects as the leading end area 777D of the second embodiment.

The electrical field moderating portion 772E may be formed in an approximately cylindrical shape extending from an outer side of the collection portion 771E in the second plate-shaped portion 773E, extending in the same direction as the collection portion 771E (that is, in the +Z direction). An inner diameter and an outer diameter of the electrical field moderating portion 772E may be the same as an inner diameter and an outer diameter of the third cylindrical portion 774E. The electrical field moderating portion 772E may be formed so that the leading end area 777E of the collection portion 771E does not protrude outward from a leading end area 778E of the electrical field moderating portion 772E.

A groove portion 779E may be formed between an inner circumferential surface of the electrical field moderating portion 772E and an outer circumferential surface of the collection portion 771E.

A through-hole 781E for discharging targets 27 that have flowed into the groove portion 779E from the groove portion 779E may be provided in a base end of the electrical field moderating portion 772E. The targets 27 discharged from the through-hole 781E can flow along the second plate-shaped portion 773E under the force of gravity and accumulate in the receptacle area 782E as target material 271E.

The anchoring portion 754E may anchor the first electrode 751E and the second electrode 752E to the nozzle 712A.

The anchoring portion 754E may be formed of an insulative material in an approximately circular plate shape. Note that the anchoring portion 754E may be formed in an approximately cylindrical shape.

An insertion hole 792E may be provided in the anchoring portion 754E. A diameter of the insertion hole 792E may be substantially the same as the outer diameter of the nozzle main body 713A and the outer diameter of the output portion 714A. An outer diameter of the anchoring portion 754E may be greater than an outer diameter of the first cylindrical portion 761E. An outer diameter of the anchoring portion 754E may be substantially the same as an outer diameter of the second cylindrical portion 785E.

The anchoring portion 754E may be anchored to the nozzle 712A so that the nozzle 712A is fitted into the insertion hole 792E. A lower surface of the anchoring portion 754E may be positioned higher than a leading end of the output portion 714A. The first electrode 751E may be anchored to the anchoring portion 754E so that the first cylindrical portion 761E is fitted into the anchoring portion 754E. The second electrode 752E may be anchored to the anchoring portion 754E so that the second cylindrical portion 785E is fitted into the anchoring portion 754E.

By anchoring the elements in this manner, an axis of the collection portion 771E and an axis of the second through-hole 776E can substantially match the axis of the nozzle 712A. A distance between the second plate-shaped portion 773E of the second electrode 752E and the first plate-shaped portion 760E of the first electrode 751E can be greater than a distance between the protruding portion 715A and the first plate-shaped portion 760E.

The leading end area 778E of the electrical field moderating portion 772E and a leading end area 780E of the third cylindrical portion 774E may be formed having smoothly-curved surface shapes. Forming the leading end area 778E and the leading end area 780E having a curved surface shape in this manner makes it possible to suppress an electrical field from concentrating at those areas.

In addition, by positioning the leading end area 778E closer to the nozzle 712A than the leading end area 777E, an electrical field can be limited from concentrating at the leading end area 777E even in the case where the leading end area 777E is pointed.

The first cylindrical portion 761E can surround the set trajectory CA of the targets 27 in an area between the tip of the nozzle 712A and the first electrode 751E. The first cylindrical portion 761E can configure a first surrounding portion 701E according to the present disclosure.

The second cylindrical portion 785E, the collection portion 771E, and the electrical field moderating portion 772E can surround the set trajectory CA of the targets 27 in an area between the first electrode 751E and the second electrode 752E. The second cylindrical portion 785E, the collection portion 771E, and the electrical field moderating portion 772E can configure a second surrounding portion 702E according to the present disclosure.

The second temperature control section 80E may serve as a heating unit according to the present disclosure. The second temperature control section 80E may be configured to control a temperature of the second electrode 752E. The second temperature control section 80E may include the second heater 801A, the second heater power source 802A, the second temperature sensor 803A, the second temperature controller 804A, and a third heater 805E.

The second heater 801A may be provided on a second surface of the second plate-shaped portion 773E that is on the side thereof that is further from the nozzle 712A. The third heater 805E may be provided on an outer circumferential surface of the second cylindrical portion 785E, downward in the gravitational direction 10B.

The second heater power source 802A may supply power to the second heater 801A and the third heater 805E based on signals from the second temperature controller 804A. Through this, targets 27 that adhere to the leading end area 777E of the collection portion 771E, the target material 271E that has accumulated in the receptacle area 782E, and so on can be heated via the second electrode 752E.

The second temperature sensor 803A may be provided in the second plate-shaped portion 773E, in the vicinity of the third cylindrical portion 774E. The second temperature sensor 803A may be configured to send a signal corresponding to a detected temperature to the second temperature controller 804A. The temperature detected by the second temperature sensor 803A can be substantially the same as the temperature of the target material 271E in the receptacle area 782E.

The target control unit 90E may control the temperature of the targets 27 that adhere to the leading end area 777E, the temperature of the target material 271E that has accumulated in the receptacle area 782E, and so on by sending a signal to the second temperature controller 804A.

3.4.2 Operation

In the following, descriptions of operations identical to those in the first and second embodiments will be omitted.

In the target supply device 7E, the second temperature control section 80E may heat the second electrode 752E to a predetermined temperature greater than or equal to the melting point of the target material 270. The target supply device 7E may then extract the target material 270 in the target generator 71A in a shape of a droplet.

In the case where the trajectory of the target 27 has shifted from the set trajectory CA, the target 27 can adhere to the outer circumferential surface of the collection portion 771E. Upon adhering to the collection portion 771E, the target 27 can flow under the force of gravity and flow into the groove portion 779E without hardening. The targets 27 that have flowed into the groove portion 779E can be discharged from the through-hole 781E under the force of gravity and accumulate in the receptacle area 782E in liquid form as the target material 271E. As a result, a force that pulls the next target 27 toward the collection portion 771E can be prevented from arising.

After this, when the targets 27 are extracted consecutively, the trajectory of the targets 27 can be shifted from the set trajectory CA until the targets 27 make contact with the entire region of the ring-shaped region on the inner edge side of the leading end surface 717A. However, the targets 27 that have deviated from the set trajectory CA can accumulate in the receptacle area 782E in liquid form, and thus the targets 27 can be prevented from building up on the second electrode 752E in a branch shape manner. As a result, a force that pulls the next target 27 toward the collection portion 771E can be prevented from arising.

When the center position of the target 27 that adheres to the tip of the nozzle 712A substantially matches the set trajectory CA, the target 27 can pass through the second through-hole 776E and be outputted from the target supply device 7E without making contact with the collection portion 771E.

The mist 279 can adhere to the first cylindrical portion 761E, the second cylindrical portion 785E, the collection portion 771E, and the electrical field moderating portion 772E. Accordingly, the first cylindrical portion 761E that configures the first surrounding portion 701E and the second cylindrical portion 785E, the collection portion 771E, and the electrical field moderating portion 772E that configure the second surrounding portion 702E can prevent the mist 279 from adhering to the anchoring portion 754E, and can thus prevent the anchoring portion 754E from becoming positively charged.

As described above, the target supply device 7E can prevent the solid target material from building up in a branch shape manner on the second electrode 752E, and thus the targets 27 can be outputted correctly.

Furthermore, the target supply device 7E can prevent the insulation withstand voltage between the nozzle 712A and the first electrode 751E and the insulation withstand voltage between the first electrode 751E and the second electrode 752E from dropping, and can thus prevent the occurrence of insulation breakdown. Furthermore, changes in the output direction of the charged targets 27 can be suppressed.

3.5 Variations

Note that the following configurations may be employed as the target supply device.

In the first embodiment, the first electrode 751D of the second embodiment may be employed instead of the first electrode 751A. Likewise, in the second embodiment, the first electrode 751A of the first embodiment may be employed instead of the first electrode 751D.

The leading end areas 777A, 777D, and 777E of the corresponding collection portions 771A, 771D, and 771E may not be pointed.

The leading end area 778D of the third cylindrical portion 772D and the leading end area 778E of the electrical field moderating portion 772E may not be formed having curved surface shapes.

The above-described embodiments and the modifications thereof are merely examples for implementing the present disclosure, and the present disclosure is not limited thereto. Making various modifications according to the specifications or the like is within the scope of the present disclosure, and other various embodiments are possible within the scope of the present disclosure. For example, the modifications illustrated for particular ones of the embodiments can be applied to other embodiments as well (including the other embodiments described herein).

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

What is claimed is:

1. A target supply device comprising:

a tank including a nozzle;

a first electrode provided with a first through-hole and disposed so that a center axis of the nozzle is positioned within the first through-hole;

a second electrode, including a main body portion provided with a second through-hole and a collection portion formed in a cylindrical shape extending in a direction from a circumferential edge of the second through-hole toward the nozzle, disposed so that the center axis of the nozzle is positioned within the second through-hole;

a third electrode disposed within the tank; and a heating unit configured to heat the second electrode, wherein the second electrode includes an electrical field moderating portion that is formed in a cylindrical shape extending in the same direction as the collection portion from an outer side of the collection portion of the main body portion and is provided so that a leading end of the electrical field moderating portion in the extending direction is positioned closer to the nozzle than a leading end of the collection portion in the extending direction.

* * * * *